US008358920B2

(12) United States Patent
Rahmani et al.

(10) Patent No.: US 8,358,920 B2
(45) Date of Patent: Jan. 22, 2013

(54) WATER HEATER TANK WITH CONVEX HEADS

(75) Inventors: Ramin K. Rahmani, Johnson City, TN (US); Rodney R. Syler, Franklin, TN (US)

(73) Assignee: A. O. Smith Corporation, Milwaukee, WI (US)

( * ) Notice: Subject to any disclaimer, the term of this patent is extended or adjusted under 35 U.S.C. 154(b) by 267 days.

(21) Appl. No.: 12/949,567

(22) Filed: Nov. 18, 2010

(65) Prior Publication Data

US 2012/0128337 A1 May 24, 2012

(51) Int. Cl.
*A47J 27/00* (2006.01)
*B65D 88/00* (2006.01)

(52) U.S. Cl. ..... 392/441; 220/567.3

(58) Field of Classification Search ..... 392/441, 392/447–451; 220/567.3, 581–584, 4.12, 220/4.21, 4.24
See application file for complete search history.

(56) References Cited

U.S. PATENT DOCUMENTS

| | | | | |
|---|---|---|---|---|
| 163,747 | A | 5/1875 | Cummings | |
| 1,581,176 | A | 4/1926 | Cook | |
| 1,665,608 | A | 4/1928 | Schneider et al. | |
| 2,199,481 | A | 5/1940 | Chappell | |
| 2,804,534 | A * | 8/1957 | Coates | 392/452 |
| 3,207,358 | A | 9/1965 | Fliss | |
| 3,366,263 | A | 1/1968 | Murdock | |
| 3,501,043 | A | 3/1970 | Jernberg | |
| 3,722,732 | A | 3/1973 | Edlund | |
| 4,027,374 | A | 6/1977 | Rutherford | |
| 4,175,670 | A | 11/1979 | Reynolds et al. | |
| 4,243,194 | A | 1/1981 | Moore, Jr. et al. | |
| 4,313,545 | A | 2/1982 | Maeda | |
| 4,380,306 | A | 4/1983 | Knopf | |
| 4,417,667 | A | 11/1983 | Roth et al. | |
| 4,452,226 | A | 6/1984 | Daugirda et al. | |
| 4,777,347 | A * | 10/1988 | Mottershead | 392/452 |
| 5,215,247 | A * | 6/1993 | Lewis | 228/184 |
| 5,217,140 | A | 6/1993 | Lindahl | |
| 5,923,819 | A * | 7/1999 | Ross et al. | 392/441 |
| 6,588,378 | B1 | 7/2003 | Henderson et al. | |
| 7,036,677 | B1 * | 5/2006 | Funck et al. | 220/581 |
| 7,421,784 | B2 * | 9/2008 | Akkala et al. | 29/890.03 |
| 7,475,791 | B2 | 1/2009 | Jaslow | |
| 2002/0066731 | A1 | 6/2002 | Wang | |
| 2005/0167436 | A1 | 8/2005 | Adam | |
| 2008/0308689 | A1 | 12/2008 | Syler | |

FOREIGN PATENT DOCUMENTS

| | | |
|---|---|---|
| WO | 03044436 | 5/2003 |

* cited by examiner

*Primary Examiner* — Sang Paik
(74) *Attorney, Agent, or Firm* — Michael Best & Friedrich LLP

(57) ABSTRACT

A tank for a water-heating appliance including a body, a first head, and a second head. The body includes a first end, a second end, and a longitudinal axis. The body extends along the longitudinal axis from the first end to the second end. The first head includes multiple landings. The first head is coupled to the first end so that the first head is convex and extends away from the body. The longitudinally outermost points of the landings define a first plane perpendicular to the longitudinal axis. The second head includes multiple landings. The second head is identical to the first head except for at least one opening through a landing. The second head is coupled to the second end so that the second head is convex and extends away from the body. The longitudinally outermost points of the landings define a second plane perpendicular to the longitudinal axis.

20 Claims, 7 Drawing Sheets

WATER HEATER TANK WITH CONVEX HEADS

BACKGROUND

The present invention relates to tanks for water-heating appliances, and more particularly to tanks for water heaters.

The tank for a typical water heater includes a hollow tank body, a lower head, and an upper head. The lower head is concave and extends into the tank body thereby decreasing the potential storage capacity of the tank. The lower head is manufactured from relatively thick steel. The upper head is convex and extends away from the tank body. The convex upper head is manufactured from thinner steel than the concave lower head.

SUMMARY

The present invention provides, in one aspect, a tank for a water-heating appliance. The tank includes a body, a first head, and a second head. The body includes a first end, a second end, and a longitudinal axis. The body extends along the longitudinal axis from the first end to the second end. The first head includes multiple landings. The first head is coupled to the first end so that the first head is convex and extends away from the body. Each of the landings includes a longitudinally outermost point. The longitudinally outermost points define a first plane perpendicular to the longitudinal axis. The second head includes multiple landings. The second head is identical to the first head except for at least one opening through a landing. The second head is coupled to the second end so that the second head is convex and extends away from the body. Each of the landings includes a longitudinally outermost point. The longitudinally outermost points define a second plane perpendicular to the longitudinal axis.

The present invention provides, in another aspect, an electric water heater. The electric water heater includes a tank, a jacket, and a heating element. The tank includes a body, an upper head, and a lower head. The body includes an upper end, a lower end, and a longitudinal axis. The body extends along the longitudinal axis from the upper end to the lower end. The lower head includes multiple landings. The lower head is coupled to the lower end so that the lower head is convex and extends away from the body. Each of the landings includes a longitudinally outermost point. The longitudinally outermost points define a first plane perpendicular to the longitudinal axis. The upper head includes multiple landings. The upper head is identical to the lower head except for at least one opening through a landing. The upper head is coupled to the upper end so that the upper head is convex and extends away from the body. Each of the landings includes a longitudinally outermost point. The longitudinally outermost points define a second plane perpendicular to the longitudinal axis. The jacket surrounds the tank. The heating element extends into the tank.

The present invention provides, in another aspect, a method of manufacturing a tank for a water-heating appliance. The method includes the step of forming a first head including multiple landings. Each of the landings includes a longitudinally outermost point. The longitudinally outermost points define a first plane. The method includes the step of forming a second head identical to the first head. The second head includes multiple landings. Each of the landings includes a longitudinally outermost point. The longitudinally outermost points define a second plane. The method includes the step of thereafter creating at least one opening through a landing of the second head. The method includes the step of providing a body including a first end, a second end, and a longitudinal axis. The body extends along the longitudinal axis from the first end to the second end. The method includes the step of coupling the first head to the first end so that the first head is convex and extends away from the body and so that the first plane is perpendicular to the longitudinal axis. The method includes the step of coupling the second head to the second end so that the second head is convex and extends away from the body and so that the second plane is perpendicular to the longitudinal axis.

The present invention provides, in another aspect, a method of manufacturing a head for a water-heating appliance that is usable as one of an electric water heater lower head, an electric water heater upper head, and a gas water heater upper head. The method includes the step of forming multiple identical heads. Each head includes a multiple landings. The method includes the step of using at least one head of the identical heads as an electric water heater lower head. The method includes the step of using at least one head of the identical heads as an electric water heater upper head after creating an opening through a landing of the head. The method includes the step of using at least one head of the identical heads as a gas water heater upper head after creating an opening through a landing and creating a central opening through the head.

Other features and aspects of the invention will become apparent by consideration of the following detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

DETAILED DESCRIPTION

Figure 1:
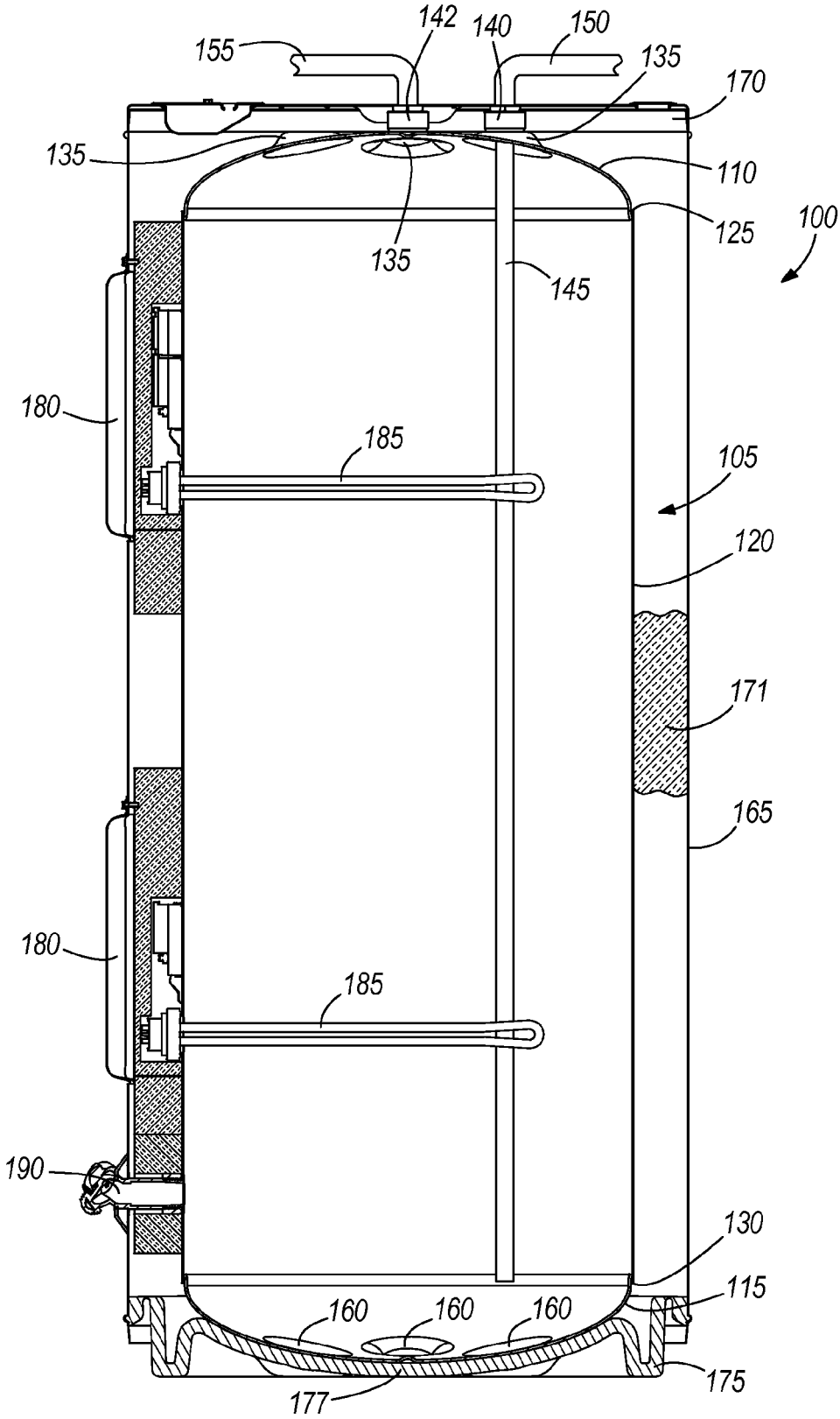
FIG. 1 is a sectional view of an electric water heater.

FIG. 1 shows an electric water heater 100 including a tank 105. The tank 105 includes an upper head 110, a lower head 115, and a body 120.

Figure 4:
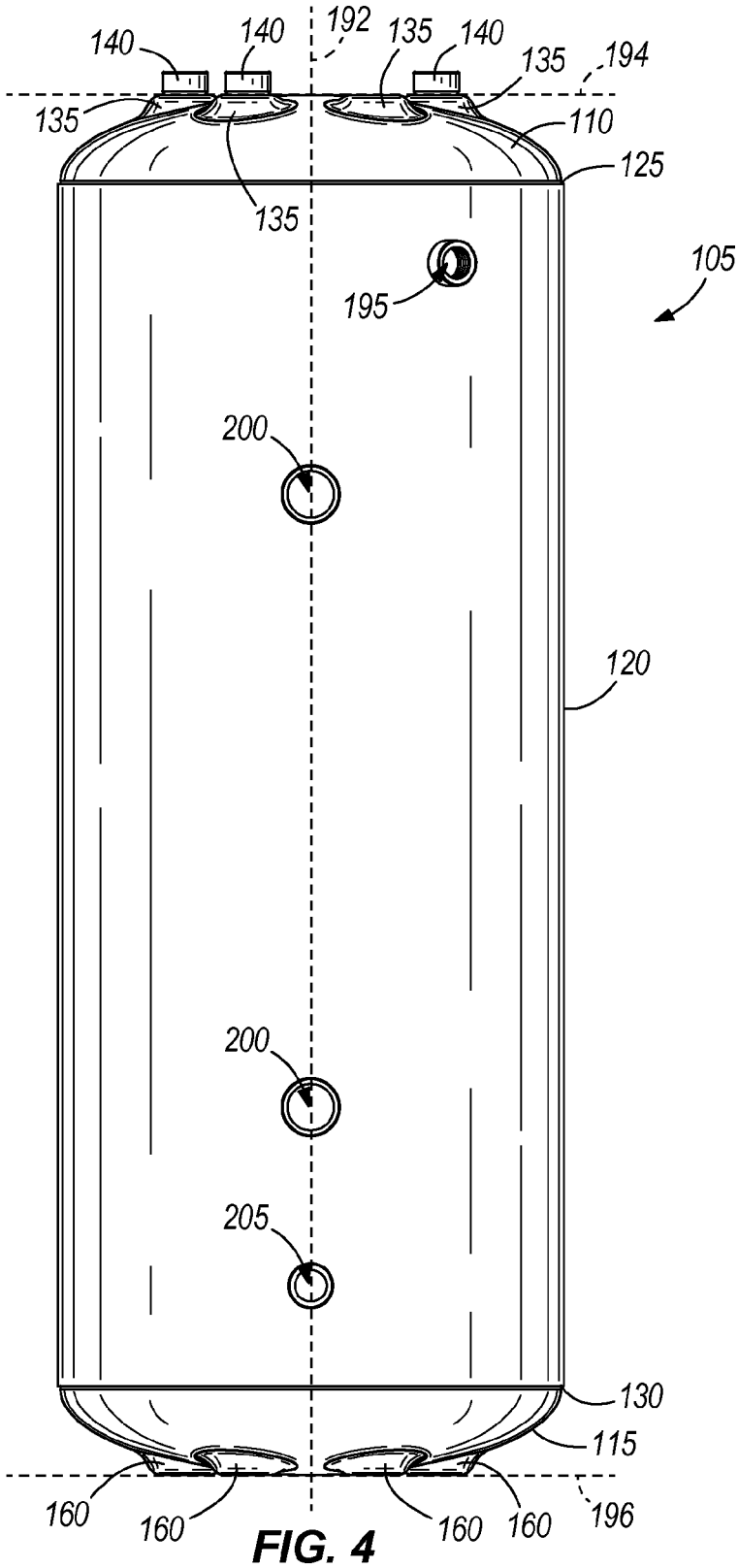
FIG. 4 is a front view of a tank of the electric water heater of FIG. 1.
Figure 5:
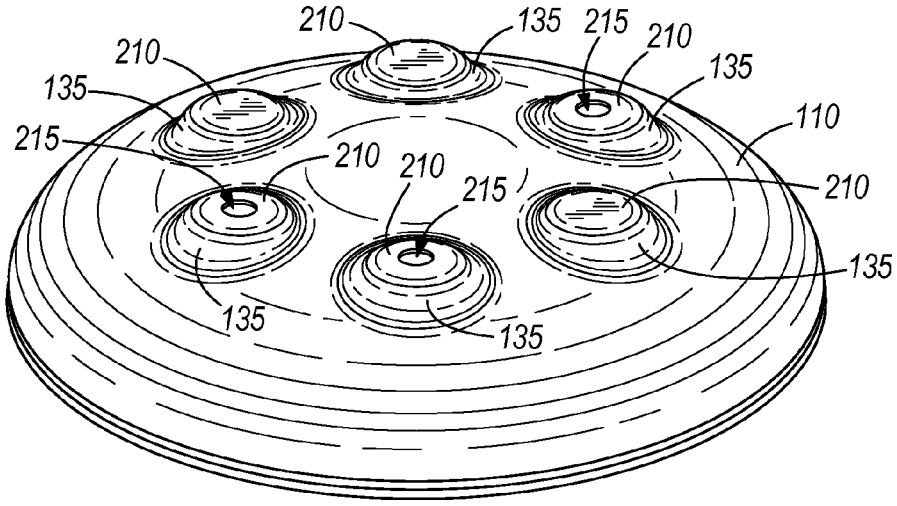
FIG. 5 is a perspective view of an upper head of the tank of FIG. 4.
Figure 6:
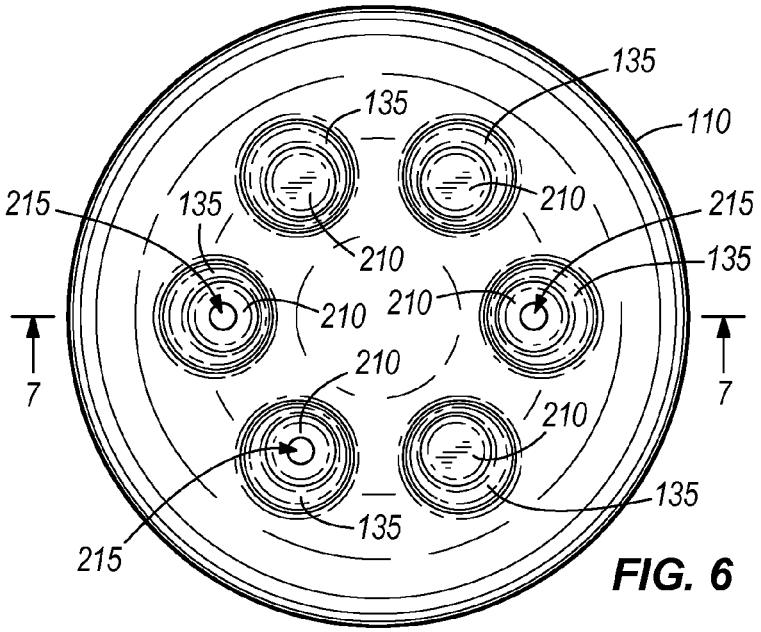
FIG. 6 is a top view of the upper head of FIG. 5.
Figure 7:
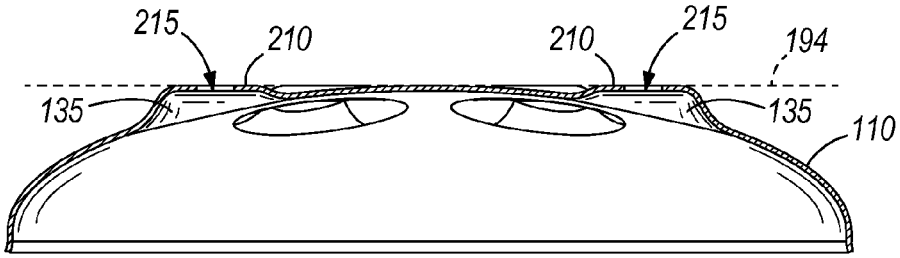
FIG. 7 is a sectional view of the upper head of FIG. 6 along line 7-7.

FIGS. 5-7 show the upper head 110. The upper head 110 is curved and includes six raised landings 135. The upper head 110 is convex so that it extends away from the body 120, as shown in FIG. 4. Each landing 135 includes a flat surface 210. The flat surface 210 includes the longitudinally outermost point of each landing 135. The longitudinally outermost points are also the uppermost points when the upper head 110 is coupled to the tank 105 and the axis 192 of the tank 105 is vertical, as shown in FIG. 4. A first plane 194 is defined by the longitudinally outermost points of the landings 135 of the upper head 110. The plane 194 is perpendicular to the longitudinal axis 192 when the upper head 110 is coupled to the tank 105. As shown in FIGS. 5-7, three of the landings 135 include an opening 215 through the flat surface 210. More or fewer openings 215 can be formed through the landings 135 as needed. The openings 215 allow the landings 135 to function as spud landings for coupling a spud 140 or other component (e.g. a T&P valve, an anode) to the upper head 110. A spud 140 or other component is positioned in an opening 215 and then coupled to the corresponding landing 135. Preferably, the spud 140 or other component is coupled to the landing 135 by welding. As shown in FIG. 1, a first spud 140 is coupled to a first landing 135 and a second spud 142 is coupled to a second landing 135. Increasing the number of landings 135 increases the number of possible locations for coupling a spud 140 or other component to the upper head 110. Preferably, the landings 135 are equiangularly spaced around the center point of the upper head 110.

Figure 11:
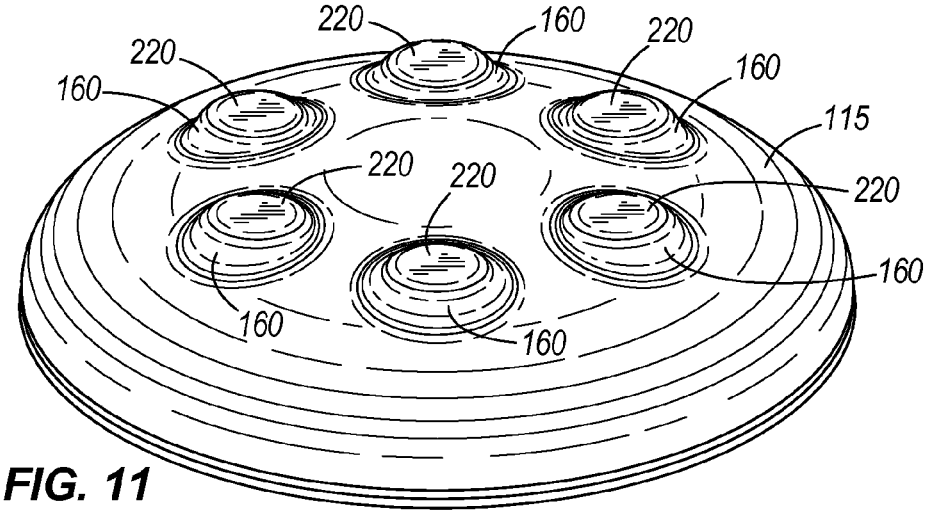
FIG. 11 is a perspective view of a lower head of the tank of FIG. 4.

FIG. 11 shows the lower head 115. The lower head 115 is curved and includes six raised landings 160. The lower head 115 is identical to the upper head 110 except that the upper head 110 includes at least one opening 215 through a landing 135. The lower head 115 is convex so that it extends away from the body 120, as shown in FIG. 4. Each landing 160 includes a flat surface 220. The flat surface 220 includes the longitudinally outermost point of each flat landing 160. The longitudinally outermost points are also the lowermost points when the lower head 115 is coupled to the tank 105 and the axis 192 of the tank 105 is vertical, as shown in FIG. 4. A second plane 196 is defined by the longitudinally outermost points of the landings 160 of the lower head 115. The plane 196 is perpendicular to the longitudinal axis 192 when the lower head 115 is coupled to the tank 105. When the tank 105 is stood on the lower head 115, the landings 160 function as legs that allow the tank 105 to free-stand on a flat surface or floor without an additional stand, rack, legs, or other securing device. The ability of the tank 105 to free-stand is particularly valuable during the manufacturing process because the tank 105 can be stored in an upright position on a flat surface without the need for a securing device to hold the tank 105 upright. More or fewer landings 160 can be used. Increasing the number of landings 160 increases the stability of the tank 105. Preferably, the landings 160 are equiangularly spaced around the center point of the lower head 115.

As shown in FIGS. 1 and 4, the body 120 is a hollow cylinder with an upper end 125, a lower end 130, and a longitudinal or center axis 192, as shown in FIG. 4. The upper head 110 is coupled to the upper end 125 of the body 120 and the lower head 115 is coupled to the lower end 130 of the body 120. Preferably, the upper head 110 and the lower head 115 are coupled to body 120 by welding. As shown in FIG. 4, the body 120 includes an opening 195 for receiving a temperature and pressure (T&P) valve, a pair of openings 200, each opening 200 for receiving a heating element 185, and an opening 205 for receiving a drain valve 190. The body 120 can include more or fewer openings as needed. In some embodiments, the opening 195 for receiving a T&P valve is not included and the T&P valve is instead coupled to a landing 135.

Figure 2:
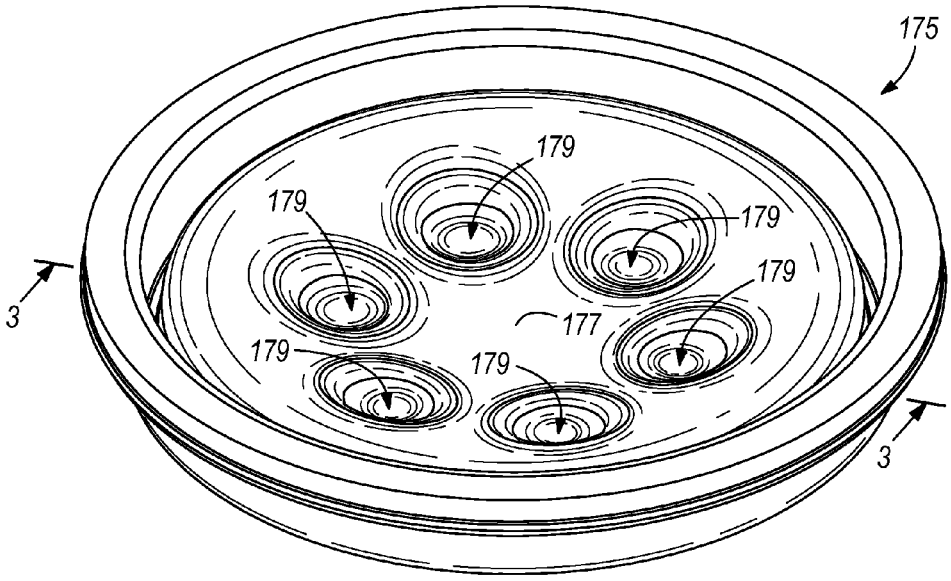
FIG. 2 is a perspective view of a base of the electric water heater of FIG. 1
Figure 3:
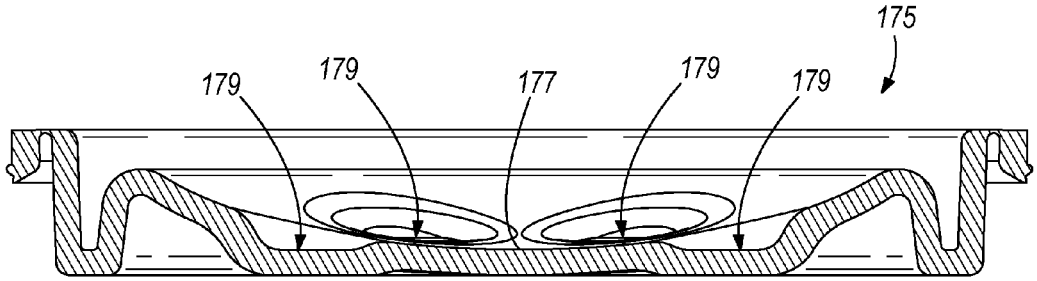
FIG. 3 is a sectional view of the base of FIG. 2 along line 3-3.

As shown in FIG. 1, the electric water heater 100 also includes a jacket 165, a cover 170, and a base 175. The jacket 165 is a hollow cylinder that extends from an upper end to a lower end and surrounds the tank 105. Alternatively, the jacket 165 can be other hollow shapes. Insulation 171 (partially shown) is provided between the jacket 165 and the tank 105. The cover 170 is coupled to the upper end of the jacket 165. As necessary, the cover 170 includes openings to accommodate spuds 140, pipes 150 and 155, valves, anodes, and other components that are coupled to the upper head 110. The base 175 is coupled to the lower end of the jacket 165. As shown in FIGS. 2 and 3, the base 175 includes a curved portion 177 and six pockets 179. The curved portion 177 has the same curvature as the lower head 115 and receives the lower head 115 with the pockets 179 each receiving a corresponding landing 160.

As shown in FIG. 1, a dip tube 145 and a cold water supply pipe 150 are coupled to the spud 140 to supply cold water to the tank 105. A hot water supply pipe 155 is coupled to the spud 142 to deliver hot water from the tank 105. Two electric heating assemblies 180 are coupled to the tank 105. Each electric heating assembly 180 includes a heating element 185 that extends into the tank 105. In use, the electric heating elements 185 heat the water stored in the tank 105. The drain valve 190 is coupled to the tank 105 to allow water to be drained from the tank 105.

The tank 105 of the electric water heater 100 provides several advantages over prior art tanks. The concave lower heads of prior art tanks are made of relatively thick material (e.g. steel) to withstand the pressure of the water in the tank. A convex lower head 115 can be made with thinner steel than known concave lower heads, thereby reducing the amount of steel needed to form a head and reducing the weight of the head. The tank body 120 can be made shorter than tank bodies for prior art tanks of a similar volume to tank 105 because the convex lower head 115 does not extend into the tank body 120 and thereby reduce the potential volume of the tank body 120. Making the tank body 120 shorter than the prior art tank bodies reduces the amount of steel needed to form the tank body 120 and also reduces the weight of the tank body 120. The tank 105 is shorter, lighter weight, stronger, and uses less steel than prior art tanks. These size, weight, and material savings of the tank 105 lead to savings in other materials including insulation, jacket steel, paint, and packaging material and also reduce shipping costs for the electric water heater 100.

Figure 8:
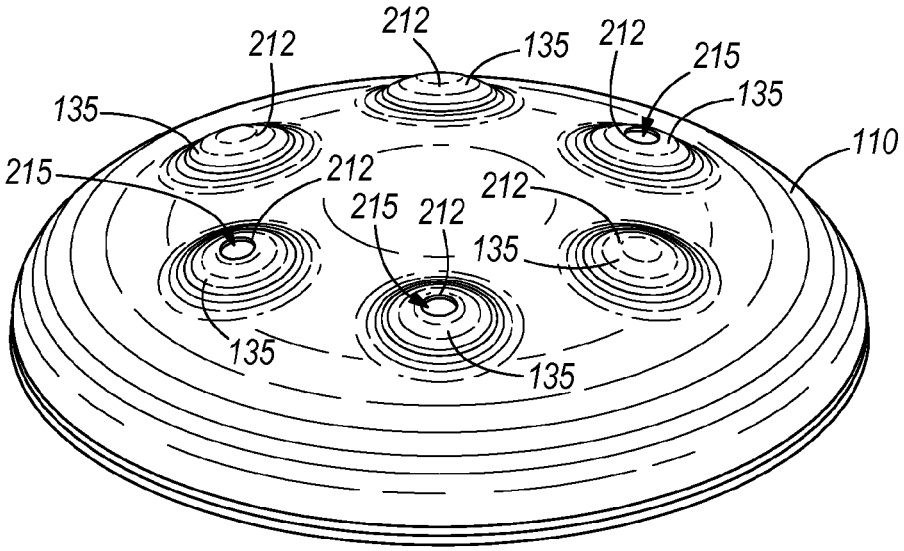
FIG. 8 is a perspective view of an alternative upper head.
Figure 9:
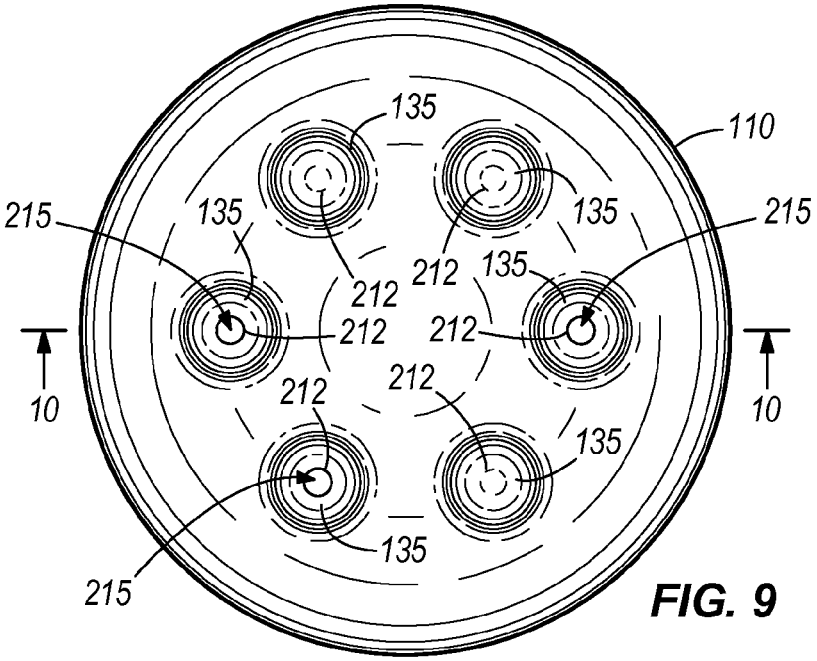
FIG. 9 is a top view of the upper head of FIG. 8.
Figure 10:
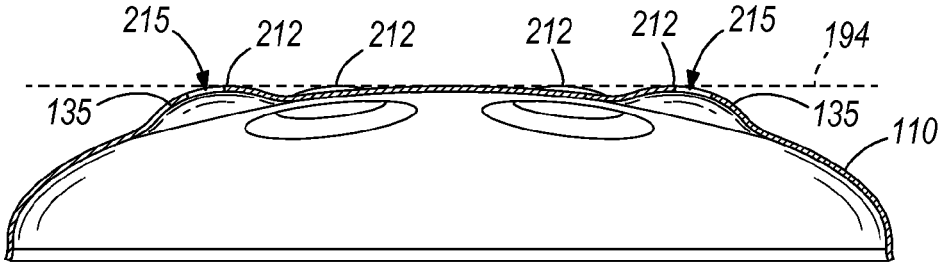
FIG. 10 is a sectional view of the upper head of FIG. 9 along line 10-10.

Alternatively, as shown in FIGS. 8-10, the upper head 110 includes landings 135 that are curved in a dome shape. Each curved landing 135 includes a longitudinally outermost point 212. The longitudinally outermost points 212 are also the uppermost points when the upper head 110 is coupled to the tank 105 and the axis 192 of the tank 105 is vertical.

Figure 12:
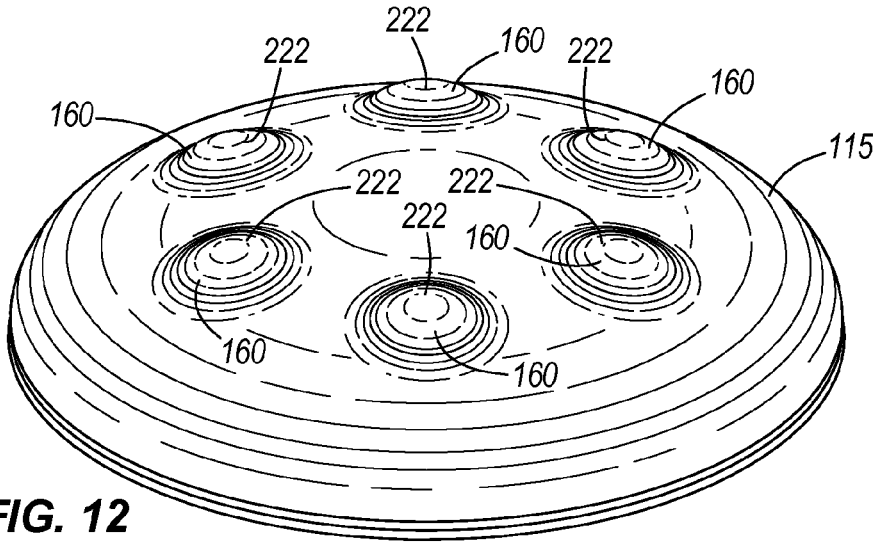
FIG. 12 is a perspective view of an alternative lower head.

Alternatively, as shown in FIG. 12, the lower head 115 includes landings 160 that are curved in a dome-shape. The lower head 115 with curved landings is identical to the upper head 110 with curved landings except that the upper head 110 includes at least one opening 215 through a landing 135. Each curved landing 135 includes a longitudinally outermost point 222. The longitudinally outermost points are also the lowermost points when the lower head 115 is coupled to the tank 105 and the axis 192 of the tank 105 is vertical.

The upper head 110 with flat landings 135 (FIGS. 5-7) and the lower head 115 with flat landings 160 (FIG. 11) are identical when initially formed. Similarly, the upper head 110 with curved landings 135 (FIGS. 8-10) and the lower head 115 with curved landings 160 (FIG. 12) are identical when initially formed. Therefore, the upper head 110 and the lower head 115 can be initially formed with the same die. Using the same die to initially form both the upper head 110 and the lower head 115 decreases tooling costs, reduces inventory, and increases manufacturing flexibility. In a second forming step for the upper head 110, the openings 215 through the landings 135 of the upper head 110 are formed as needed. A head 110, 115 with curved landings (FIGS. 8-10 and 12) is stronger and slightly easier to form than a head 110, 115 with flat landings (FIGS. 5-7 and 11). A spud 140 or other component may be easier to weld to the flat landings 135 (FIGS. 5-7) than the curved landings 135 (FIGS. 8-10).

Figure 13:
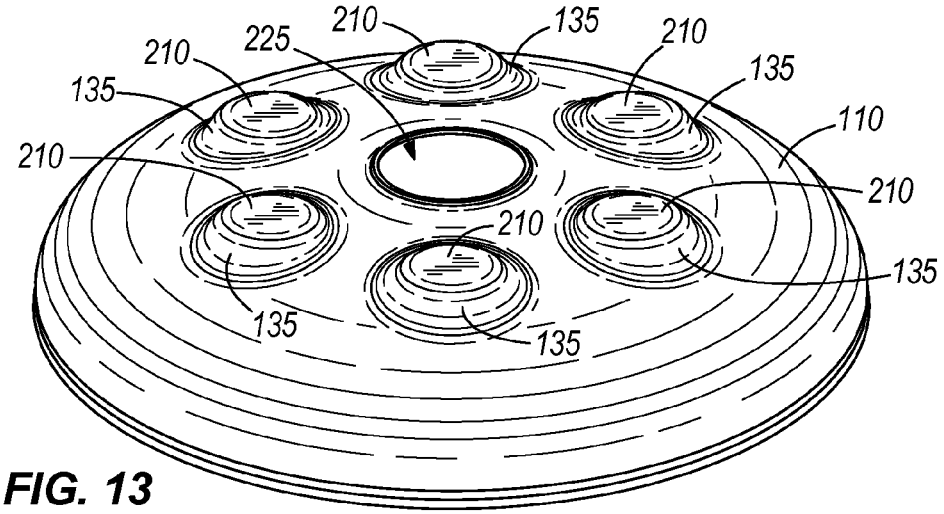
FIG. 13 is a perspective view of an upper head including a central opening.
Figure 14:
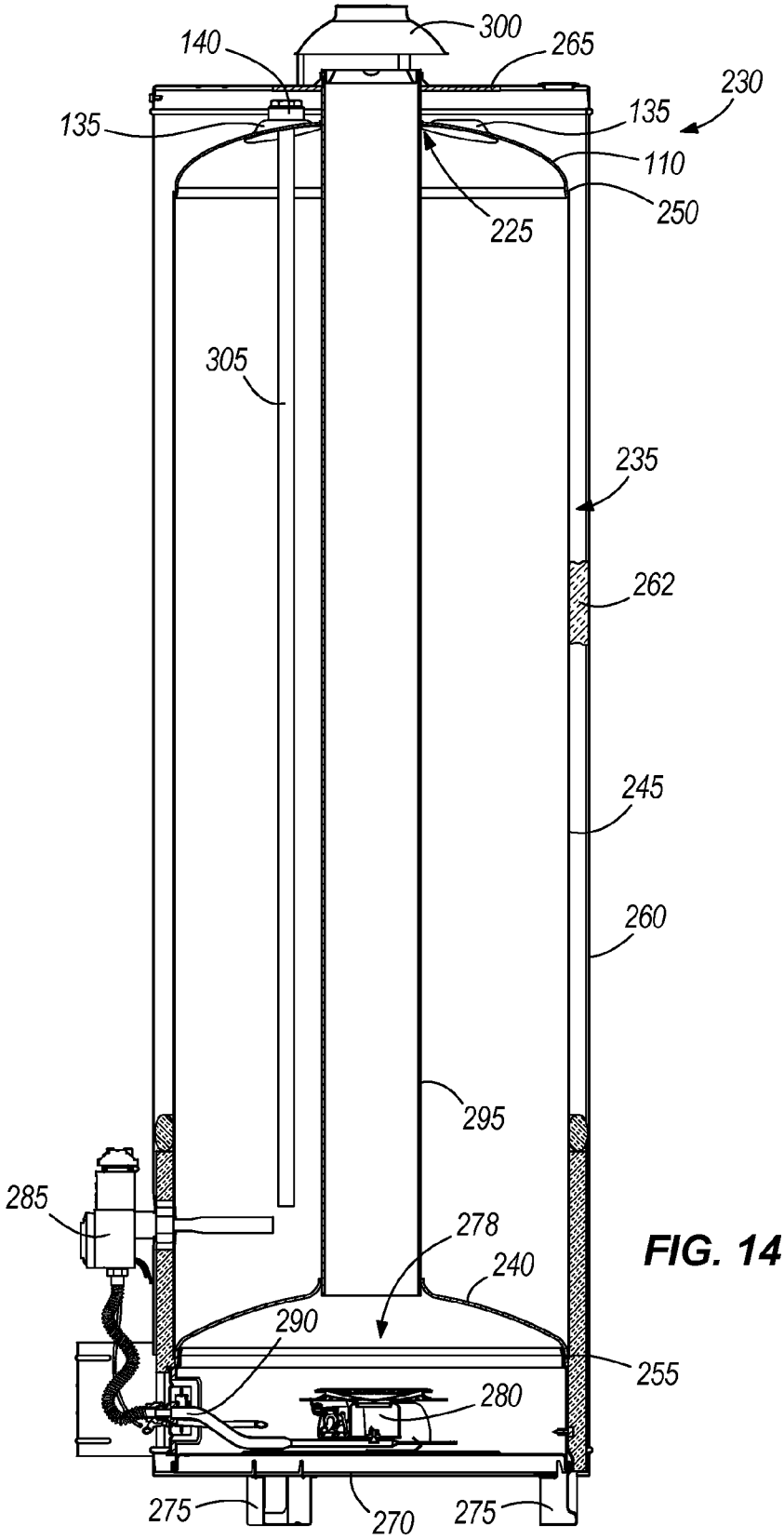
FIG. 14 is a sectional view of a gas water heater including the upper head of FIG. 13.

FIG. 13 shows an upper head 110 including a central opening 225. The upper head 110 shown in FIG. 13 is identical to the upper head 110 shown in FIGS. 5-7, except for the central opening 225 through the upper head 110. The landings 135 are shown as including a flat surface 210 but could also be curved as shown in FIGS. 8-10. Openings through the landings 135 can be formed as needed. As shown in FIG. 14, when the upper head 110 shown in FIG. 13 is used as a component of a gas water heater 230, the central opening 225 is used to receive a flue 295. Alternatively, the upper head 110 shown in FIG. 13 is used as a component of an electric water heater 100. The central opening 225 is used to provide access for a spray nozzle or nozzles used to "glass" or coat the interior of the tank 105 of the electric water heater 100. Glassing the interior of the tank 105 inhibits corrosion of the tank 105. A cap, plug, or cover (not shown) is used to close the central opening 225 before the tank 105 is filled with water. In this way, the upper head 110 shown in FIG. 13 can be used for a gas water heater 230 and for an electric water heater 100.

FIG. 14 shows the gas water heater 230 including a tank 235. The tank 235 includes the upper head 110, a lower head 240, and a body 245. The body 245 is a hollow cylinder with an upper end 250 and a lower end 255. The upper head 110 is coupled to the upper end 250 of the body 245. The upper head 110 is convex so that it extends away from the body 245. A spud 140 is coupled to a landing 135 of the upper head 110. The lower head 240 is coupled to the lower end 255 of the body 245. The lower head 240 is concave so that it extends into the body 245. Preferably, the upper head 110 and the lower head 240 are coupled to the body 245 by welding. The gas water heater 230 also includes a jacket 260, a cover 265, and a base 270. The jacket 260 is a hollow cylinder that surrounds the tank 235. Alternatively, the jacket 260 can be other hollow shapes. Insulation 262 (partially shown) is provided between the jacket 260 and the tank 235. The cover 265 is coupled to the upper end of the jacket 260. As necessary, the cover 265 includes openings to accommodate spuds 140, pipes, valves, anodes and other components that are coupled to the upper head 110. The base 270 is coupled to the lower end of the jacket 260. The base 270 includes multiple legs 275 that allow the gas water heater 230 to be stood upright on a flat surface or floor. A combustion chamber 278 is positioned between the base 270 and the lower head 240 and a burner 280 is located in the combustion chamber 278. A gas valve 285 is coupled to the tank 235 and coupled to a fuel supply (not shown). A fuel line 290 supplies fuel from the gas valve 285 to the burner 280. The flue 295 is positioned above the burner 280. The flue 295 extends from the combustion chamber 278, through the tank 235, through the central opening 225 of the upper head 110, and past the cover 265. An exhaust hood 300 is coupled to the cover 265 above the flue 295. A dip tube 305 is coupled to the spud 140. The spud 140 is also coupled to a water supply so that the dip tube 305 supplies water to the tank 235. A second spud (not shown) is coupled to a second landing 135 and a hot water supply pipe (not shown) to deliver hot water from the tank 235. In use, fuel and air are combusted by the burner 280. The products of combustion flow through the flue 295, thereby heating the water stored in the tank 235. The gas water heater 230 is conventional except for the upper head 110.

The upper head 110 including the central opening 225 (FIG. 13) can be formed with the same die used to form the upper head 110 (FIGS. 5-7) and the lower head 115 (FIG. 11) for an electric water heater. To form the upper head 110 shown in FIG. 13, the central opening 225 is created through the upper head 110. The central opening 225 can be created with a separate tool or created with a removable insert added to the die.

Various features of the invention are set forth in the following claims.

What is claimed is:

1. A tank for a water-heating appliance comprising:

a body including a first end, a second end, and a longitudinal axis, the body extending along the longitudinal axis from the first end to the second end;

a first head including a first plurality of landings, the first head coupled to the first end so that the first head is convex and extends away from the body, each of the first plurality of landings including a longitudinally outermost point, the longitudinally outermost points defining a first plane perpendicular to the longitudinal axis; and a second head including a second plurality of landings, the second head identical to the first head except for at least one opening through a landing, the second head coupled to the second end so that the second head is convex and extends away from the body, each of the second plurality of landings including a longitudinally outermost point, the longitudinally outermost points defining a second plane perpendicular to the longitudinal axis.

2. The tank of claim 1, wherein each landing of the first plurality of landings includes a flat surface and the flat surfaces define the first plane; and wherein each landing of the second plurality of landings includes a flat surface and the flat surfaces define the second plane.

3. The tank of claim 2, wherein the opening is formed through the flat surface of the landing.

4. The tank of claim 3, wherein the landings of the first plurality of landings are positioned equiangularly around a center point of the first head; and wherein the landings of the second plurality of landings are positioned equiangularly around a center point of the second head.

5. The tank of claim 2, wherein the landings of the first plurality of landings are positioned equiangularly around a center point of the first head; and wherein the landings of the second plurality of landings are positioned equiangularly around a center point of the second head.

6. The tank of claim 1, wherein each landing of the first plurality of landings is curved; and wherein each landing of the second plurality of landings is curved.

7. The tank of claim 6, wherein the landings of the first plurality of landings are positioned equiangularly around a center point of the first head; and wherein the landings of the second plurality of landings are positioned equiangularly around a center point of the second head.

8. The tank of claim 1, wherein the landings of the first plurality of landings are positioned equiangularly around a center point of the first head; and wherein the landings of the second plurality of landings are positioned equiangularly around a center point of the second head.

9. An electric water heater comprising:

a tank including a body, a lower head, and an upper head, the body including an upper end, a lower end, and a longitudinal axis, the body extending along the longitudinal axis from the upper end to the lower end, the lower head including a first plurality of landings, the lower head coupled to the lower end so that the lower head is convex and extends away from the body, each of the first plurality of landings including a longitudinally outermost point, the longitudinally outermost points defining a first plane perpendicular to the longitudinal axis, the upper head including a second plurality of landings, the upper head identical to the lower head except for at least one opening through a landing, the upper head coupled to the upper end so that the upper head is convex and extends away from the body, each of the second plurality of landings including a longitudinally outermost point, and the longitudinally outermost points defining a second plane perpendicular to the longitudinal axis;

a jacket surrounding the tank; and a heating element extending into the tank.

10. The tank of claim 9, further comprising a base shaped to receive the lower head, the base coupled to a lower end of the jacket.

11. The tank of claim 10, further comprising a cover coupled to an upper end of the jacket.

12. The tank of claim 11, further comprising a spud positioned in the opening and coupled to the corresponding landing.

13. The tank of claim 12, further comprising insulation positioned between the tank and the jacket.

14. The tank of claim 13, wherein each landing of the first plurality of landings includes a flat surface and the flat surfaces define the first plane; and wherein each landing of the second plurality of landings includes a flat surface and the flat surfaces define the second plane.

15. The tank of claim 13, wherein each landing of the first plurality of landings is curved; and wherein each landing of the second plurality of landings is curved.

16. The tank of claim 9 wherein each landing of the first plurality of landings includes a flat surface and the flat surfaces define the first plane; and wherein each landing of the second plurality of landings includes a flat surface and the flat surfaces define the second plane.

17. The tank of claim 9, wherein each landing of the first plurality of landings is curved; and wherein each landing of the second plurality of landings is curved.

18. The tank of claim 9, wherein the landings of the first plurality of landings are positioned equiangularly around a center point of the first head; and wherein the landings of the second plurality of landings are positioned equiangularly around a center point of the second head.

19. A method of manufacturing a tank for a water-heating appliance, the method comprising:

forming a first head including a first plurality of landings, each of the first plurality of landings including a longitudinally outermost point, the longitudinally outermost points defining a first plane;

forming a second head identical to the first head, the second head including a second plurality of landings, each of the second plurality of landings including a longitudinally outermost point, the longitudinally outermost points defining a second plane;

thereafter creating at least one opening through a landing of the second head;

providing a body including a first end, a second end, and a longitudinal axis, the body extending along the longitudinal axis from the first end to the second end;

coupling the first head to the first end so that the first head is convex and extends away from the body and so that the first plane is perpendicular to the longitudinal axis; and coupling the second head to the second end so that the second head is convex and extends away from the body and so that the second plane is perpendicular to the longitudinal axis.

20. A method of manufacturing a head for a water-heating appliance that is usable as one of an electric water heater lower head, an electric water heater upper head, and a gas water heater upper head, the method comprising:

forming a plurality of identical heads, each head including a plurality of landings;

using at least one head of the identical heads as an electric water heater lower head;

using at least one head of the identical heads as an electric water heater upper head after creating an opening through a landing of the head; and using at least one head of the identical heads as a gas water heater upper head after creating an opening through a landing and creating a central opening through the head.

* * * * *